US006032697A

United States Patent [19]

Kennedy

[11] Patent Number: 6,032,697

[45] Date of Patent: Mar. 7, 2000

[54] COVER FOR STANDPIPES

[76] Inventor: James M. Kennedy, 819 E. 575 North, American Fork, Utah 84003

[21] Appl. No.: 09/292,320

[22] Filed: Apr. 15, 1999

[51] Int. Cl.[7] ..... F16L 57/00

[52] U.S. Cl. ..... 138/96 R; 138/89.4; 138/110

[58] Field of Search ..... 138/967, 110, 138/89.4

[56] References Cited

U.S. PATENT DOCUMENTS

| | | | |
|---|---|---|---|
| 2,942,625 | 6/1960 | Costanzo | 138/26 R |
| 3,587,654 | 6/1971 | Yocum | 138/89 |
| 3,800,486 | 4/1974 | Harvey | 138/96 R |
| 4,158,407 | 6/1979 | Rest | 138/96 R |
| 4,168,726 | 9/1979 | Klennert | 138/96 R |
| 4,372,585 | 2/1983 | Evora | 138/96 R |
| 5,687,773 | 11/1997 | Ryan et al. | 138/110 |
| 5,915,899 | 6/1999 | Dennis | 138/96 R |
| 5,921,282 | 7/1999 | Castillo et al. | 138/89 |

*Primary Examiner*—James F. Hook

[57] ABSTRACT

A cover for standpipes comprising a tube of brightly colored sheet plastic having one open end and another open end turned back to form an encircling sleeve with notches cut at opposite ends of the encircling sleeve and oppositely directed draw strings, each extending from a notch, through the encircling sleeve to exit at the opposite notch.

3 Claims, 1 Drawing Sheet

COVER FOR STANDPIPES

BACKGROUND OF THE INVENTION

1. Field of the Invention

This invention relates to standpipes positioned during building construction and more particularly to a means for protecting such standpipes during and after construction and particularly as concrete floors are poured around the standpipes.

2. Prior Art

During building construction the 'rough-in' plumbing generally involves positioning of plumbing pipes, including drain pipes and inlet pipes, prior to the pouring of concrete floors or the building of floors of other materials around upwardly standing pipes to which additional piping is to be later connected. To prevent damage to the standpipes and to keep debris from failing into the standpipes, construction personnel frequently take the time to cover the tops of the standpipes with tape or other cover materials. More recently many construction codes now require that standpipes be protected from contact with poured cement, since such contact may subsequently cause deterioration of the standpipes.

BRIEF SUMMARY OF THE INVENTION

Objects of the Invention

Principal objects of the invention are to provide a cover for standpipes that will adapt to use with standpipes of a variety of sizes; that is inexpensive and will not significantly increase construction costs while still being sufficiently durable. Other objects are to provide a cover that will protect the entire lengths of standpipes that would otherwise be exposed to concrete and to provide a cover that is very visible to insure easy location of the covered standpipes.

Features of the Invention

Principal features of the invention include a tubular bag having a double pull closure at one end. The bag is made of durable, plastic sheet material and preferably of a brightly colored material that will serve to alert the presence of the standpipe on which the cover is placed.

Additional objects and features of the invention will become apparent to those skilled in the art to which the invention pertains from the following detailed description and drawings.

THE DRAWINGS

In the drawings:

FIG. 1 is a side elevation of a cover for standpipes of the invention;

FIG. 2 a fragmentary side elevation; and

FIG. 3, a view of the cover of FIG. 1. protecting a standpipe and with a cement floor, shown in section, around the standpipe and cover.

DETAILED DESCRIPTION

Figure 1:
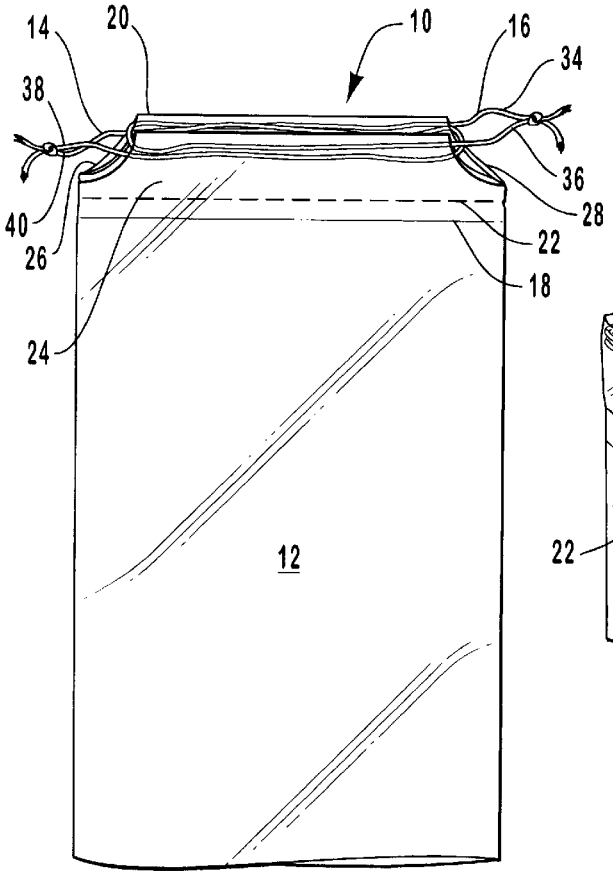
Figure 2:
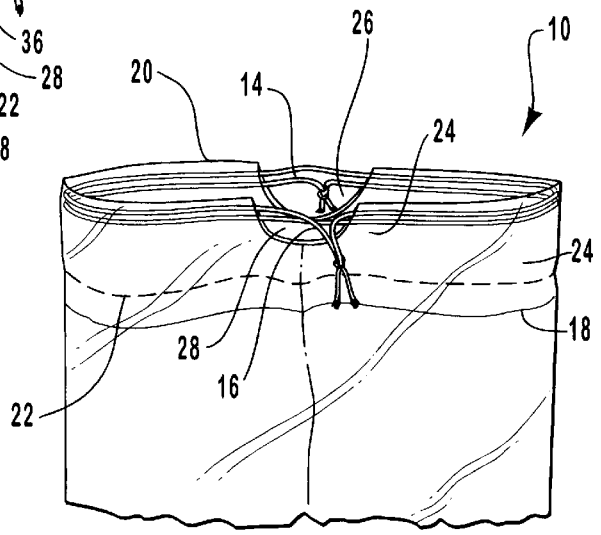

Referring now to the drawings:

In the illustrated preferred embodiment of the invention the cover, shown generally at 10, comprises a flexible tube

12 with a pair of draw strings 14 and 16 at one end. Tube 12 is made of a suitable plastic sheeting material having a thickness sufficient to allow it to be subjected to the wear of curing concrete surrounding the tube and a standpipe covered by the tube. With a tube made of polyethylene plastic a thickness of at least five millimeters has been found suitable. Other materials can be used, and the thickness of the tubes made from such other materials may be different from that of a tube made from polyethylene plastic material.

One end 18 of the tube is turned back at 20 to be sealed fully around the tube at 22 and to form an encircling sleeve 24. Sleeve 24 is notched at opposite ends 26 and 28 and draw strings 14 and 16 are inserted, with the ends 34 and 36 of string 16 being inserted from notch 26, through opposite sides of the sleeve 24, to emerge at the notch 28 and with the ends 38 and 40 of string 14 being inserted from notch 28, through opposite sides of the sleeve 24, to emerge at the notch 26. The ends 34 and 36 of draw string 16 are tied together, and the ends 38 and 40 of draw string 14 are tied together to keep the draw strings from being pulled from the sleeve 24.

Figure 3:
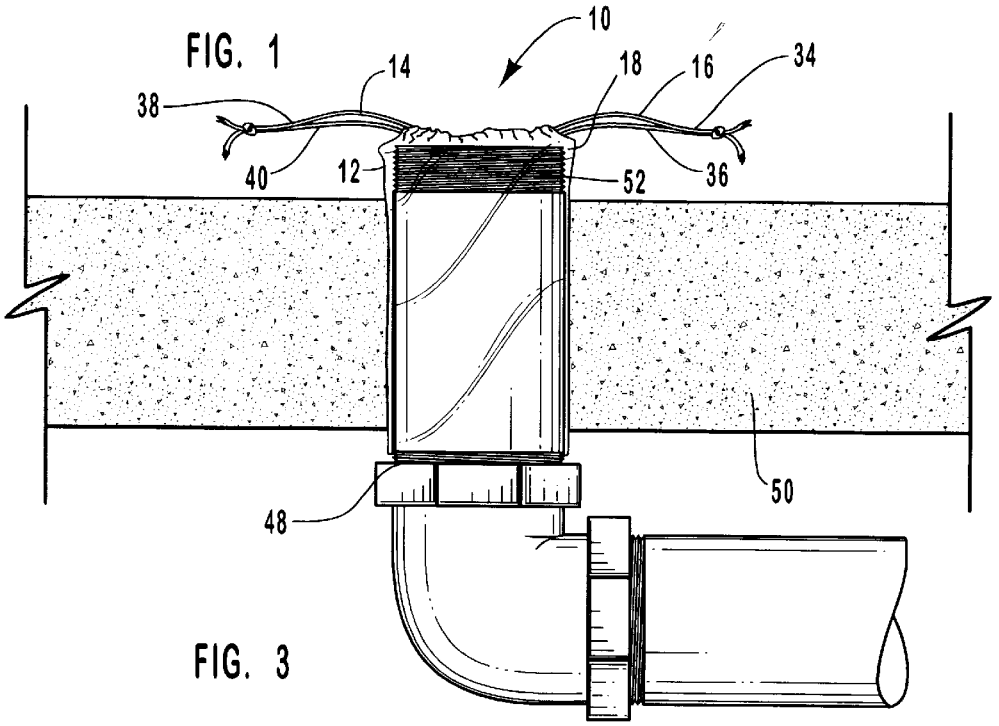

The notches 26 and 28 allow the end 18 of tube 12 to be turned down after the tube 12 has been placed over a standpipe 48 and been closed at the end 18 by pulling on the ends of both draw strings 14 and 16 and then released after surrounding concrete 50, FIG. 3, has been poured and set up. Turning the end 18 of tube 12 typically exposes a threaded end 52 of the standpipe such that the threads on the end of the standpipe can receive additional plumbing structures.

Although a preferred embodiment of my invention has been herein disclosed it is to be understood that the disclosure is by way of example and that variations are possible without departing from the subject matter coming within the scope of the following claims, which subject matter I regard as my invention.

I claim:

1. A cover for standpipes comprising a plastic tube having one open end and an opposite open end with a sleeve formed therearound, said tube being made of sheet plastic having a thickness and strength to withstand friction between a standpipe on which the tube is installed and concrete poured around the standpipe; and at least one draw string passing through and exiting said sleeve.

2. A cover for standpipes as in claim 1, wherein the tube is brightly colored.

3. A cover for standpipes as in claim 2, wherein the sleeve is notched at opposite ends thereof and includes a first draw string having ends extending from one notch through the sleeve to the other notch and a second draw string having ends extending from the other notch through the sleeve to the one notch, whereby said sleeve is foldable at the notches when the drawstrings are released.

* * * * *